US007740048B2

(12) United States Patent
Wilson

(10) Patent No.: US 7,740,048 B2
(45) Date of Patent: Jun. 22, 2010

(54) SCREEN FRAME AND ASSEMBLY

(76) Inventor: Eric P. Wilson, 259 Center St. West, Warren, OH (US) 44481

( * ) Notice: Subject to any disclaimer, the term of this patent is extended or adjusted under 35 U.S.C. 154(b) by 401 days.

(21) Appl. No.: 11/810,452

(22) Filed: Jun. 6, 2007

(65) Prior Publication Data

US 2008/0302490 A1 Dec. 11, 2008

(51) Int. Cl.
*E06B 9/24* (2006.01)
*E06B 3/80* (2006.01)
*A47H 13/00* (2006.01)

(52) U.S. Cl. ..... 160/371; 160/372; 160/380; 160/398; 160/179

(58) Field of Classification Search ..... 160/380, 160/381, 379, 378, 377, 372, 398, 404, 402, 160/399, 88, 179, 327, 371
See application file for complete search history.

(56) References Cited

U.S. PATENT DOCUMENTS 1,285,973 A * 11/1918 Fredman ..... 160/380
1,350,027 A * 8/1920 Lane ..... 160/381
2,343,037 A * 2/1944 Adelman ..... 160/381
3,192,589 A 7/1965 Pearson
3,199,258 A 8/1965 Jentoft et al.
3,220,469 A 11/1965 Oehmig
3,960,197 A * 6/1976 Daniels ..... 160/371
4,084,360 A 4/1978 Reckson
4,222,162 A 9/1980 Levy et al.
4,233,790 A 11/1980 Meadows
4,261,144 A 4/1981 Rizzo
4,290,174 A 9/1981 Kalleberg
4,410,027 A 10/1983 Lucous
4,445,563 A * 5/1984 Meyeroff ..... 160/369
4,451,997 A * 6/1984 Jones ..... 38/102.2
4,662,038 A * 5/1987 Walker ..... 24/460
4,665,670 A 5/1987 van den Burg
4,690,192 A 9/1987 Stilling
4,760,980 A 8/1988 Sharpe
4,899,797 A 2/1990 Green (Continued)

OTHER PUBLICATIONS

Advertisement of Hoover Fence Company showing attachment of shade covers to kennels, 2002, 2 pages.

(Continued)

*Primary Examiner*—Katherine W Mitchell
*Assistant Examiner*—Jaime F Cardenas-Garcia
(74) *Attorney, Agent, or Firm*—Robert J. Herberger

(57) ABSTRACT

A multi-sided frame assembly for screening has a fastening strip with male and female pads. The male pad has a first face from which spaced stems project in an ordered arrangement. The female pad has a second face formed with at least one receptacle extending into a thickness of the female pad. Each stem is located and sized for insertion into the receptacle. A woven, knit or knotted material of open texture having holes, preferable evenly spaced, such as those of a screen, is secured between the pads of the multi-sided frame by passing the stems through the mesh and into the receptacle. A cover can be removably engaged and selectively fastened to the assembled fastening strip. The cover envelops the pads, including fasteners, if any, used to fasten the male and female pads together or used to attach the multi-sided frame assembly to a supporting structure to hold the assembled frame in place.

17 Claims, 7 Drawing Sheets

U.S. PATENT DOCUMENTS

| | | | | | |
|---|---|---|---|---|---|
| 5,077,870 | A | | 1/1992 | Melbye et al. | |
| 5,301,737 | A | * | 4/1994 | Martin | 160/380 |
| 5,819,391 | A | | 10/1998 | Matsushima et al. | |
| 5,845,375 | A | | 12/1998 | Miller et al. | |
| 6,006,923 | A | | 12/1999 | Helmy et al. | |
| 6,027,079 | A | | 2/2000 | Santoro | |
| 6,044,892 | A | * | 4/2000 | Epstein | 160/380 |
| 6,112,377 | A | | 9/2000 | Wilson | |
| 6,125,910 | A | * | 10/2000 | Pepperell et al. | 160/371 |
| 6,132,666 | A | * | 10/2000 | Foley et al. | 264/313 |
| 6,318,255 | B1 | * | 11/2001 | Larson | 101/128.4 |
| 6,619,003 | B2 | * | 9/2003 | Von Arx et al. | 52/222 |
| 6,708,379 | B1 | | 3/2004 | Wilson | |
| 6,722,096 | B2 | * | 4/2004 | Von Arx et al. | 52/511 |
| 2005/0072538 | A1 | * | 4/2005 | Hoffman | 160/377 |
| 2005/0139334 | A1 | * | 6/2005 | Bernardi | 160/378 |
| 2005/0236120 | A1 | * | 10/2005 | Johnson | 160/404 |
| 2008/0110583 | A1 | * | 5/2008 | Lallemand | 160/371 |
| 2008/0178548 | A1 | * | 7/2008 | Figueroa-Morales | 52/473 |

OTHER PUBLICATIONS

New York Wire, Product Brochure, 1997, 8 pages.

* cited by examiner

SCREEN FRAME AND ASSEMBLY

FIELD OF THE INVENTION

The present invention relates to a screen framing assembly that can be used for windows, doors, porches and the like. More specifically, the present invention relates to a universal fastener assembly with cover for framing and removably fastening a screen or other meshwork and, as an alternative, for retaining a plastic film for thermal insulation or other purpose.

BACKGROUND OF THE INVENTION

Screening increases the enjoyment of the out-of-doors during warm weather. The screening blocks the entry of insects, provides shading and admits air to an otherwise enclosed area, such as a porch, or through a screened door or window. Typically, porches, doors, windows or other openings are screened by using a metal, plastic or wood frame to which the screening material is secured using a cylindrical, resilient spline often received within a sufficiently narrow groove, as shown for example in U.S. Pat. No. 2,897,889.

Periodically, the screening may need to be made taut or replaced because of damage or degradation. Also the screening can become dirty so as to require cleaning which can not be done effectively with the screen in place using the resilient spline, and it is often labor intensive to clean the screen by removing it completely. Also, with current screening units, it is often difficult or impractical to effectively remove the screen for cleaning and then reassemble to put back in place.

In some areas of the country, such as along the sea coast, where screening is especially susceptible to damage, and where relatively frequent replacement of screening is necessary, elaborate framing with removable screened elements is available. This framing is usually made of aluminum and is relatively expensive to install and often lacks flexibility.

A number of other devices exist to attach screening. Some are difficult to install, are obtrusive or lack a finished appearance. Further, if the screen needs to be covered with another material such as clear plastic, nylon or other fabric to provide additional shading or privacy, or to protect against inclement weather or very small insects, a separate fastening method, such as double-sided adhesive, nails and/or tacks are needed to secure the covering material in place over the standard metal, plastic or wood framing structure. Also, it is difficult and often in possible to use the existing spline and groove type assembly to hold thicker screening, plastic and/or fabric in place.

For these and other reasons, there is need for a more universal frame assembly having a fastening strip and cover that incorporates a screen, and like sheet material, between interlocking components, for easily fastening and unfastening. A preferred fastener and method of its use of this invention eliminates these problems. Instead, it involves securing the screen and/or fabric in a frame with a fastening strip comprising two engaging attachment pads for easy and quick assembly. The preferred fastener would also have the ability to secure multiple layers of screens or other mesh materials of various thicknesses, or otherwise penetrable sheet material, such as plastic films, with one fastening device. Also, other thicker, impenetrable plastics may be engaged between the fastening strip and an interlocking cover when desired.

SUMMARY OF THE INVENTION

One aspect of the present invention is to provide a screen retaining assembly that quickly, easily and securely engages a screen with a fastening strip having two opposing attachment pads: one pad having projecting stems and another pad formed with openings and stem receptacles or, as an alternative, an elongated groove for fastening screens and the like for framing.

Another aspect of the invention is to provide a screen retaining assembly that is easy to fabricate, versatile and economical, providing fastening in such a way that the screen can be adjusted or cleaned without damaging the screen, or replaced without damaging the framing.

A still further aspect of the invention is to provide a cover for the fastening strip that has a finished appearance so as not to detract from the appearance of the supporting structure to which the frame assembly is fastened.

Yet another aspect of the invention is to provide a screen retaining assembly having components that can be used universally, for fabricating multiple configurations, that is, with a finished, anesthetically pleasing appearance, using interchangeable parts, including elbows and T-shape structures, for selective inclusion for variable designs, irregular shapes and continuous transition between multiple planar surfaces.

Another aspect is to provide a screen frame assembly that is easily connected to a supporting structure without affecting the connection to the screen's woven mesh that can be installed by one person without assistance.

To achieve the preferred embodiment, the assembly ideally includes a low profile and is made of an all-weather, resilient plastic in white or other desirable color for low maintenance. Alternatively, the fastening strip and cover may be made of a composite material, aluminum or other metal, and easily painted as desired.

More specifically, a framing assembly in accordance with the various aspects of the present invention comprises a fastening strip having male and female pads. The male pad has a first face from which spaced stems project in a desired arrangement. The female pad has a second face formed with mutually-spaced openings formed with receptacles. More specifically, each stem is located and sized for insertion through an opening into a receptacle. As an alternative, an elongated groove may be used, in place of a plurality of single openings, for a snug, pinched fit of the stems therein. A cover is removably engageable and selectively fastened to the fastening strip to envelop the pads. A woven, knit or knotted material of open texture having holes, preferable evenly spaced, such as those of a screen, is secured between the pads by passing the stems through the mesh and into the openings or groove to the corresponding receptacle. The cover envelops the pads, including the heads of screws or other fasteners that may be used to fasten the male and female pads together or used to attach the assembly to the supporting structure to hold the frame in place. This assembly can also be used to further secure a plastic film in place by engaging it between the first and second pads of the fastening strip, or alternatively between the fastening strip and cover.

So embodied, the frame assembly does not detract from the appearance of the structure to which the screening is to be fastened. The removal of the frame cover is easily accomplished by twisting or rotating about its axial length at any point along the length of the cover. The cover once loosened can be taken off to allow access to the male and female pads of the fastening strip, and ultimately the screen, for repair, adjustment, replacement or cleaning.

These and other features, aspects and advantages of the present invention will become better understood with reference to the following description and appended claims. Reference is now made in detail to the present preferred embodiment of the invention, an example of which is given in the accompanying drawings.

DESCRIPTION OF THE DRAWINGS

The figures listed below have been selected to illustrate embodiments of the present invention. These figures along with the accompanying description are sufficient for those skilled in the art to practice the invention as claimed.

DESCRIPTION OF THE PREFERRED EMBODIMENT

Figure 1:
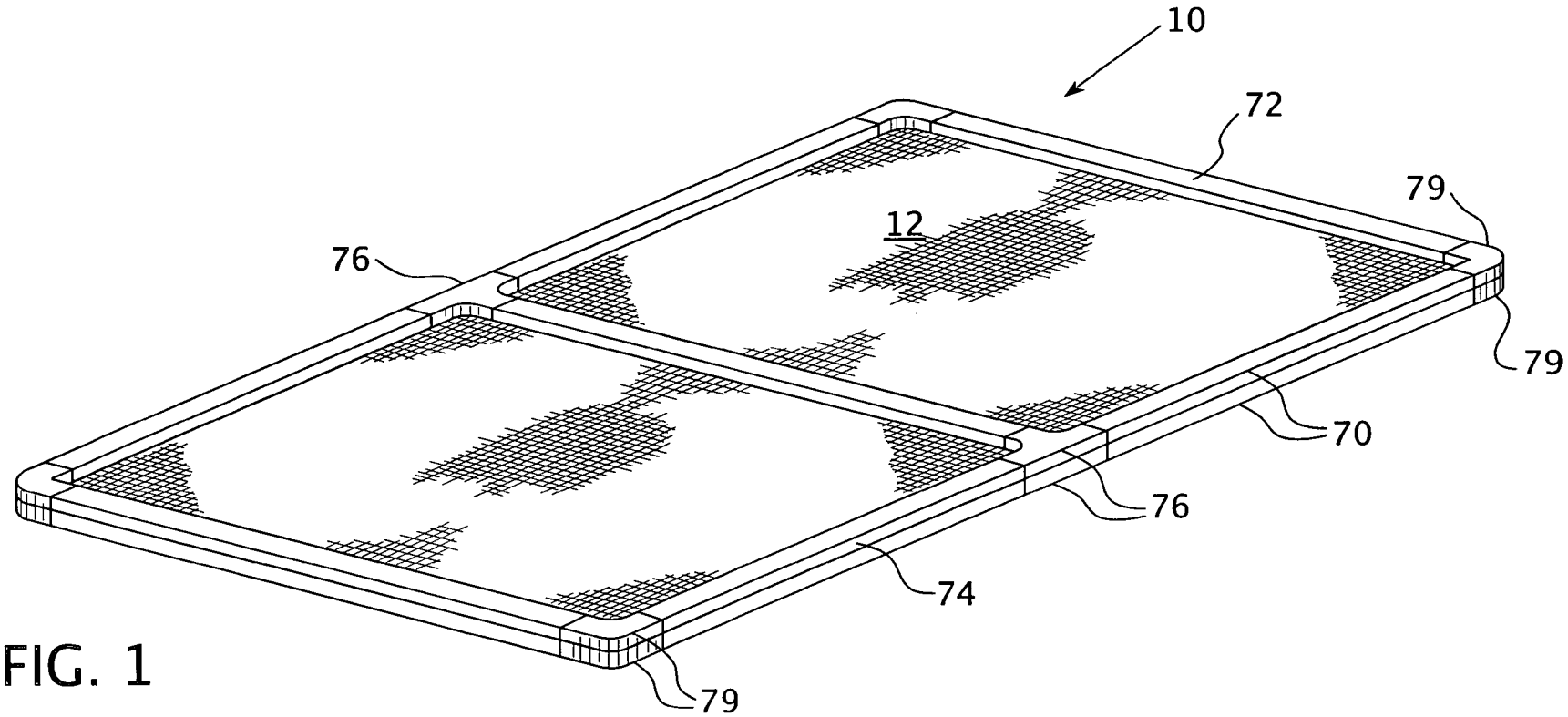
FIG. 1 is a perspective view of a representative screen frame assembly configuration.
Figure 2:
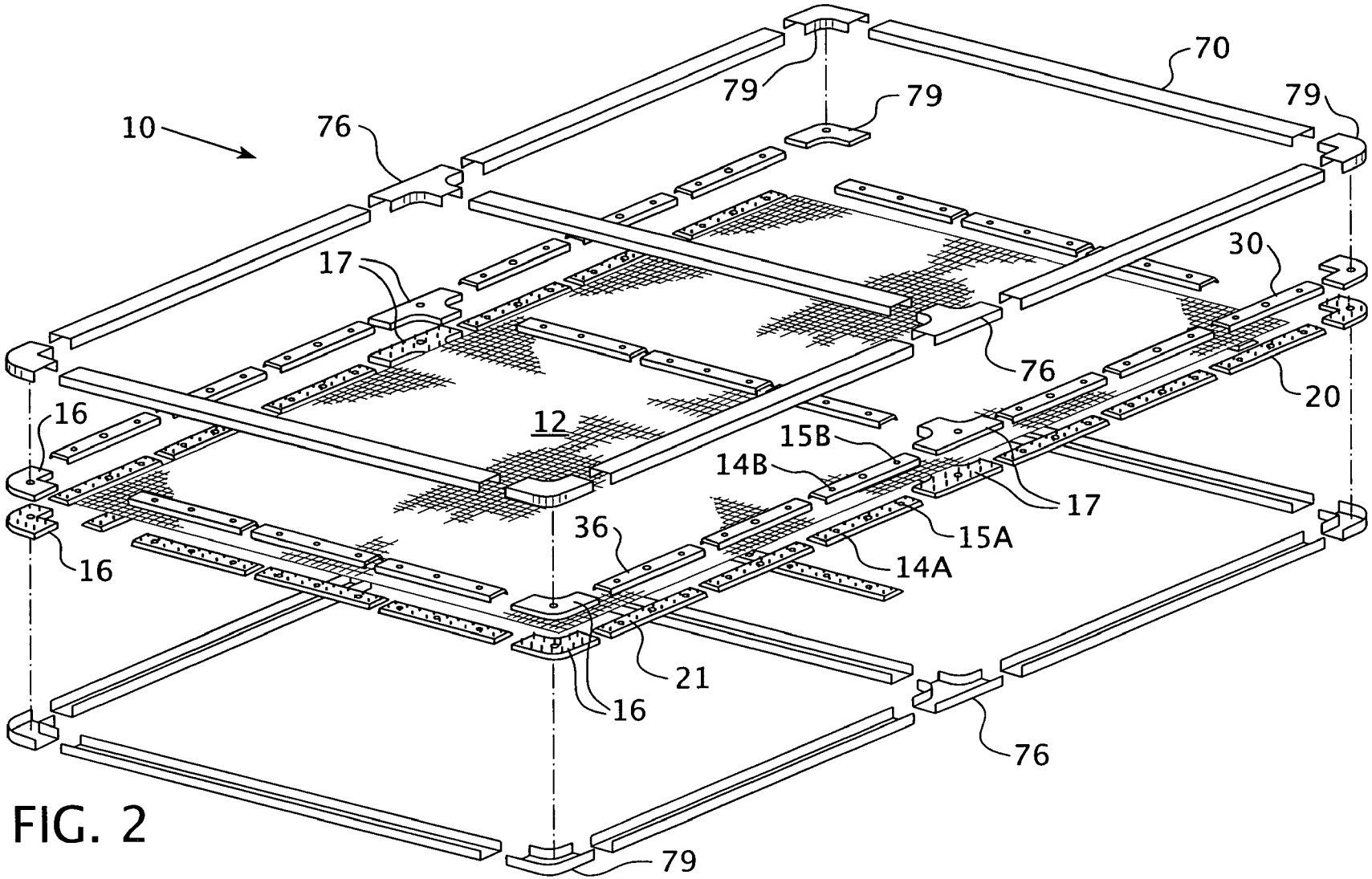
FIG. 2 is an exploded view of the components that make up the screen frame assembly shown in FIG. 1.
Figure 5:
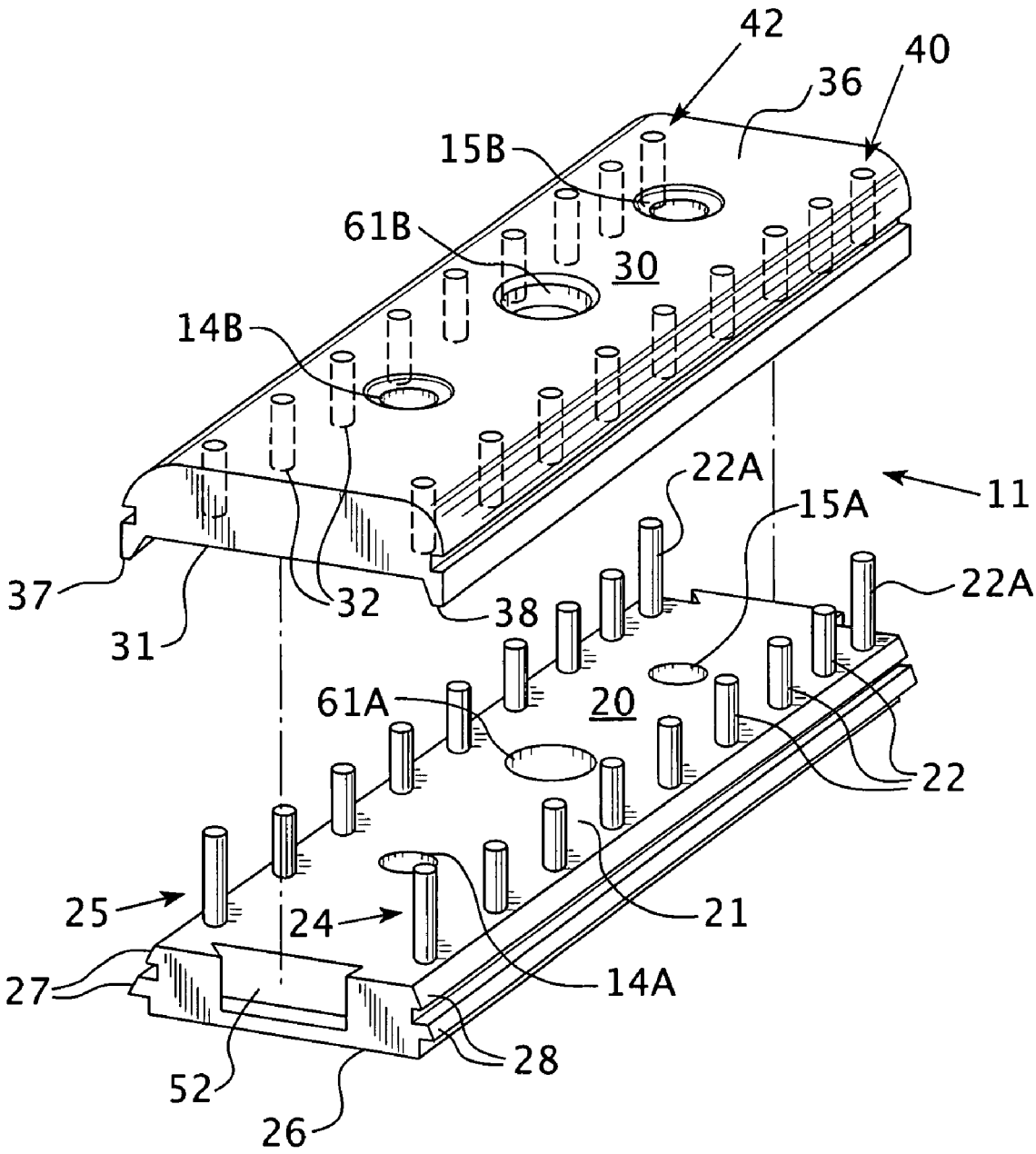
FIG. 5 is an exploded perspective view of the fastening strip.

Referring first to FIGS. 1, 2 and 5, screen frame assembly 10 according to this invention includes a fastener strip 11 having a first attachment pad 20, which is elongated in various lengths and rectangular in planform, having a planar inner face 21 from which multiple stems 22 project. The stems 22 are arranged in a spaced, ordered arrangement, preferably in rows 24, 25 extending longitudinally and columns extending laterally, so as to optimally correspond to the weave of the screen or fabric in both longitudinal or widthwise directions. This is particularly important when the spacing of the weave per inch is different longitudinally, as compared to the weave along the width of the mesh material.

The base of the pad preferably has a planar outer face 26. The pad and stems are preferably of integrally molded plastic. Alternately, these stems can be made from metal pins from a plastic or wooden base. Each stem 22 is relatively slender, i.e. narrow in width in proportion to its length or height. Each stem 22 is preferably relatively slender in the form of a cylinder projecting perpendicularly from the face 21 of the first pad 20; however, the stems 22 may have any suitable form and cross-sectional shape. Preferably the tip of each stem 22 is somewhat reduced in cross-sectional area as compared to its area below the tip and along its length. For example, when the stem 22 has the shape of a circular cylinder, the tip may be formed with a smaller radius than its base. In this way, the stem tip provides a lead that facilitates entry of the stem 22 into a receiving opening 32, or alternatively, groove 33, both of which are described in more detail below.

The lead stems 22A at each end of the first attachment pad 20 may be relatively longer in length or height to facilitate alignment with a second attachment pad 30 described below. The properties of the material of the pad 20 and stems 22, and the length and cross-sectional size of each stem provide sufficient bending flexibility to allow each stem to readily align with the receiving opening 32 or groove 33, contacting at the stem tip. Yet each stem 22 has sufficient bending stiffness to remain substantially erect under the effect of a force applied to an outer surface 36 of the pad 30 and a force resisting entry of the stems 22 into the female receptacle 34 leading from the opening 32 or groove 33.

As best seen in FIG. 5, the stems 22 are arranged in the first row 24 located on one side of evenly-spaced, pad and fastener holes 14A, 15A, and a second row 25 located at the opposite side of the holes, which passes entirely through the thickness of the pad 20.

Figure 3:
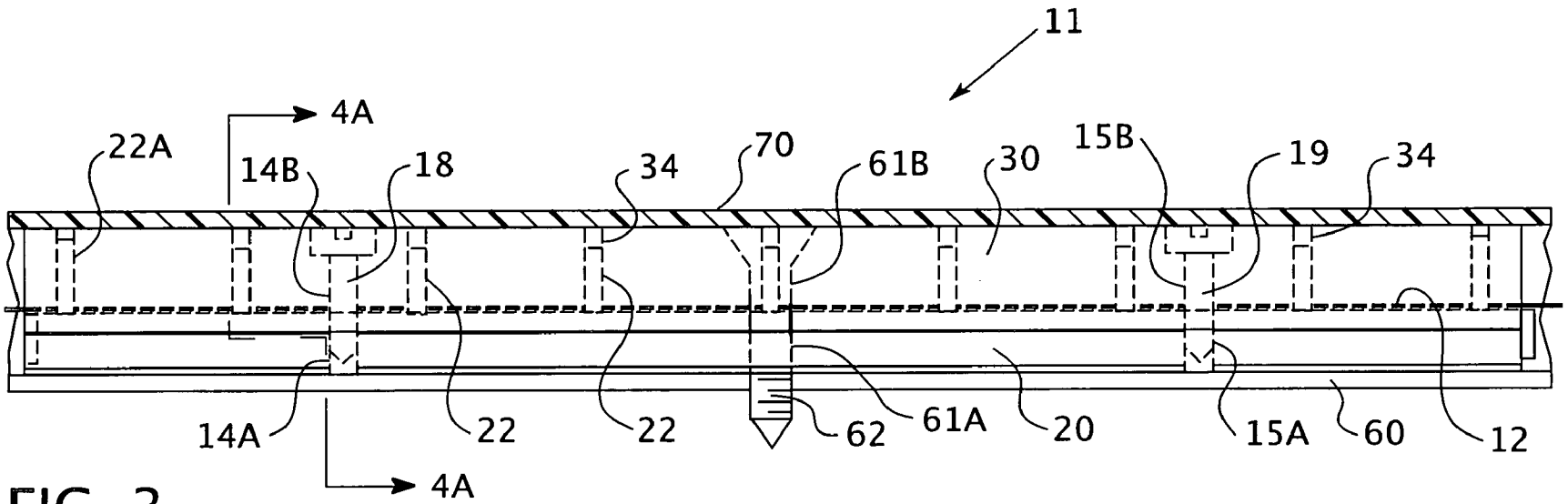
FIG. 3 is an elevational, cross-sectional side view of a length of a fastening strip and cover of the screen frame assembly shown attached to a wall structure.

An assembled fastening strip 11 can be permanently secured to a wall or other framing structure 60 using wall attachment fasteners 62 passing through wall mount openings 61A, 61B and extending therefrom into the wall, as best seen in FIG. 3. Also, an adhesive can be used on a face of the strip 11 to more easily align and hold the same in place while fastening it to the wall. As an alternative, the frame assembly can be attached to a door or window frame using a plurality of frame clips and thumb screws, like those customarily used for inset installation of aluminum screen frames in storm doors.

FIGS. 3 through 5 show the second attachment pad 30 of various lengths and rectangular in planform and having a planar inner face 31 formed with the openings 32, arranged in a mutually-spaced, ordered arrangement, preferably in rows 34, 35 and columns corresponding in position to the position of the stems 22. The planar outer surface 36 of the second pad 30 preferably has rounded side edges.

The openings are arranged in a third row 40 located on one side of the pad and fastener holes 14B, 15B, and a fourth row 42 located at the opposite side of the openings, which passes entirely through the thickness of second pad 30. The pad and fastener holes 14B, 15B are inset into the outermost surface 36 of the pad so that the head of each fastener 18, 19 sits flush. Each stem 22 of the first pad 20 is aligned with an opening 32 located on the inner face 31 of the second pad 30. When the stems 22 and openings 32 are so aligned, the centrally located pad and fastener holes 14A-14B, 15A-15B, on the pads, are aligned also. Each opening 32 is sized to allow one stem 22 to pass through the opening into the receptacle 34, formed in the thickness of the second pad 30 adjacent the opening.

Figure 4A:
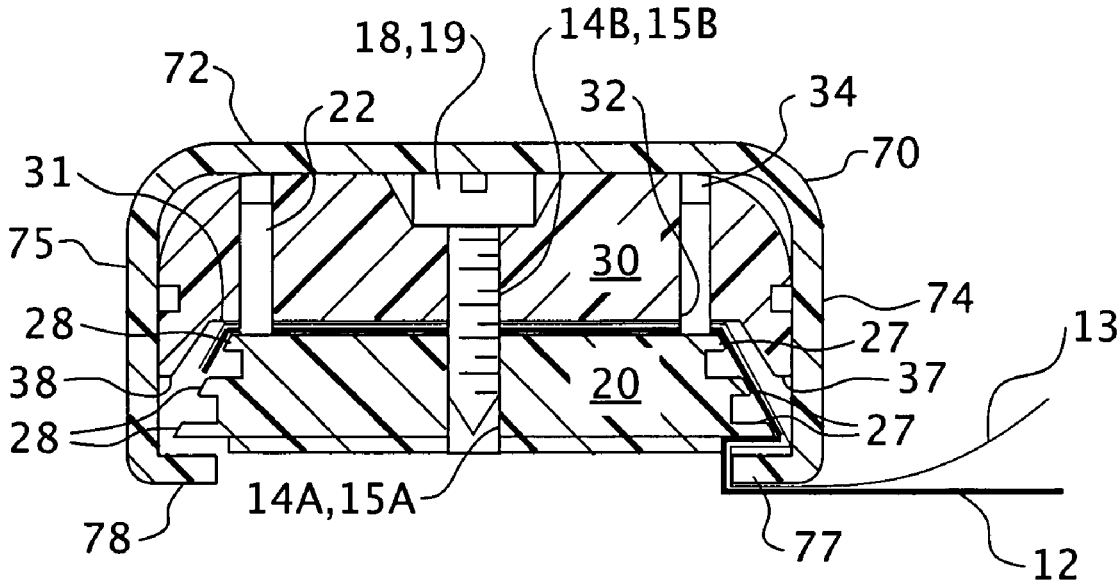
FIG. 4A is an elevational cross-section taken along line 4A-4A of FIG. 3 showing a cover with equal sidewall lengths engaging the fastening pads of the fastening strip.

FIG. 4A is a cross-section view through the first pad 20, second pad 30 and cover 70 showing a preferred configuration of the openings 32, receptacles 34, stems 22 and cover engagement teeth 27, 28 and 37, 38 on the opposite sides of the first and second pads 20, 30, respectively. Each receptacle 34 extends from an opening into the thickness of the second pad 30. The receptacle 34 may be tapered through the pad thickness, the cross-sectional area of the receptacle 34 becoming smaller as distance along its length through the thickness of the second pad 30 increases from its inner face 31 to its outer face 36. Alternatively, the receptacles 34 can have a uniform cross-sectional area along the length, preferably sized so that there is a slight interference fit between the sides of the receptacles 34 and the sides of the stems 22. In this way, the resilient, elastic material of the stems will frictionally engage the receptacles 34 to prevent the stems 22 from inadvertently sliding out of the receptacle 34, yet allow intentional removal of the stems from the receptacle.

Figure 8:
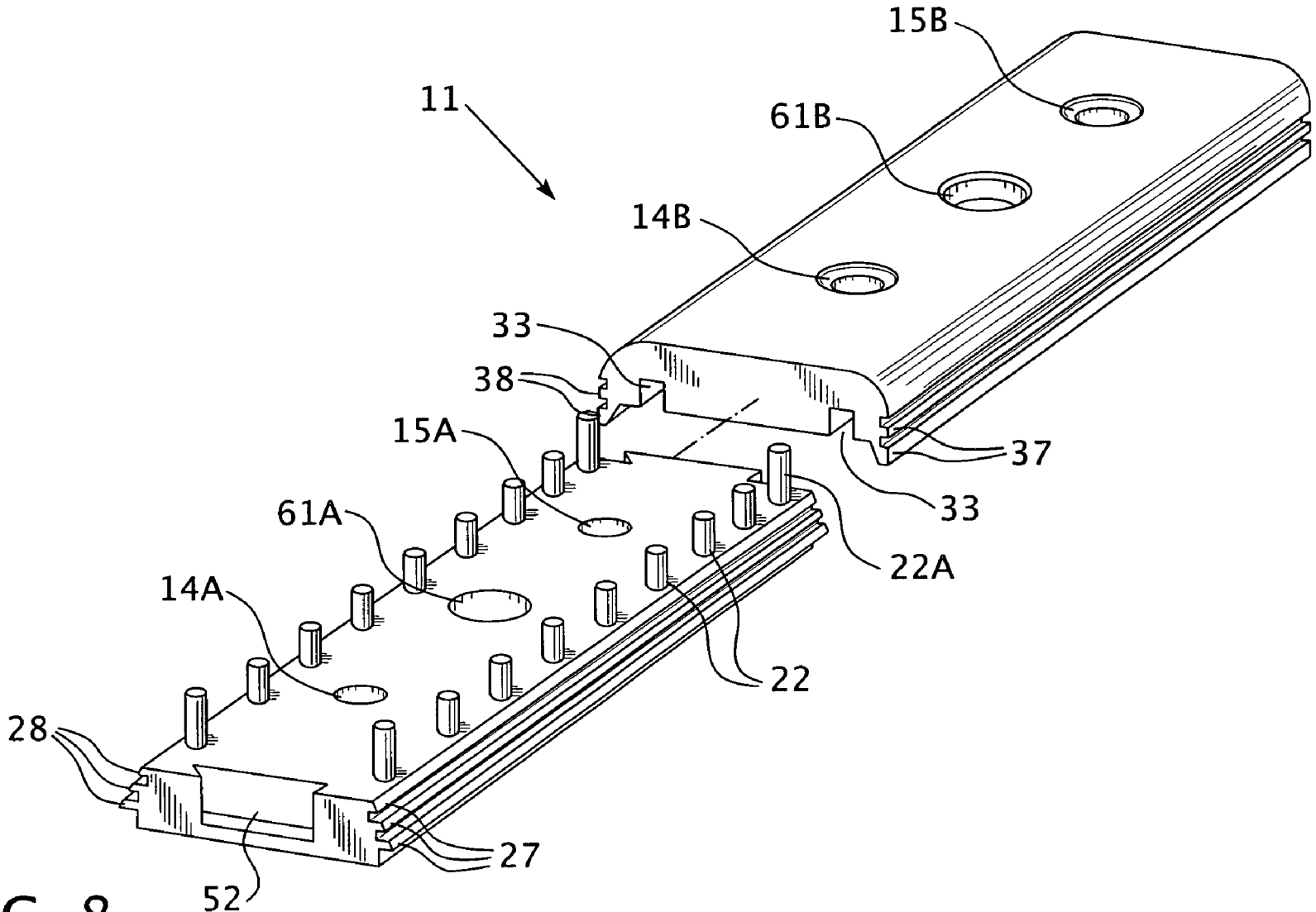
FIG. 8 is an exploded perspective view of the fastening strip with the female pad having elongated grooves, as opposed to the plurality of openings as shown in FIGS. 3 and 5.

As seen in FIG. 8, an alternative design of the second attachment pad 30 has grooves 33, instead of openings, extending in the length along rows 40 and 42, otherwise shown in FIG. 5. Preferably, the cross-section of the grooves 33 are sized so that there is a snug interference, or in other words, pinch-like fit of the stems 22, much like that described above for the openings.

As previously stated, the first attachment pad 20 can be injection molded in various standard lengths. The second attachment pad 30 is preferably injection molded if openings 32 are used, or extruded if grooves 33 are used.

Figure 7:
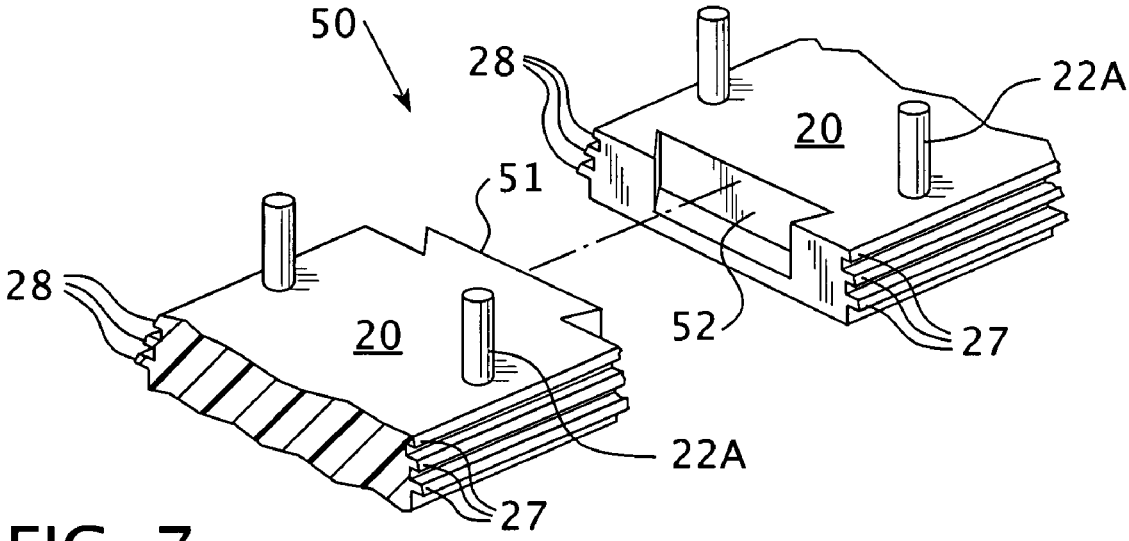
FIG. 7 is a sectional view of an interlocking attachment mechanism for joining pad ends using male and female interlocking sections for mating engagement along the axial length and width portions of a frame length.

Preferably, as seen in FIG. 7 opposing ends of each first pad 20 include an interlocking mechanism 50 having a male interlocking insert 51 and a female interlocking slot 52 for mating engagement between adjacent pad along the length and width sections of the frame assembly 10. The male interlocking insert 51 has a friction fit with the adjoining female interlocking slot 52. The ends of the second pads 30 are similarly aligned in an abutting relationship with longitudinally adjacent pads, with or without interlocking. With this construction, the fastening strips 11 of the frame can be easily assembled into various lengths. Although in the preferred embodiment, the first pads 20 are interlocking, alternative designs may include both the first pads 20 and second pads 30 having the interlocking mechanism 50 at their end. Further, just the second pads 30 can be interlocking. Still further, the interlocking mechanism 50 can be an elongated fastening pin, such as a wedge-type fastener for insertion into an elongated receiving opening in the abutting end of longitudinally adjacent pads 20 and/or 30. As previously stated, this assembly only needs interlocking engagement with either the first pad 20 or second pad 30 for structural strength and integrity.

Figure 6:
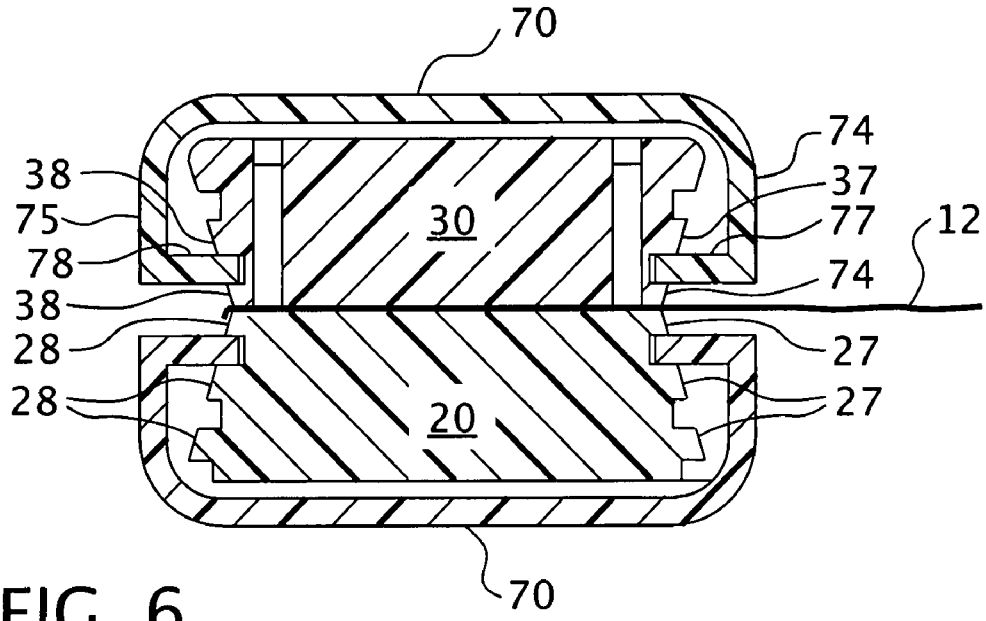
FIG. 6 is an elevational cross-section showing an alternative design of the frame assembly which may be visibly exposed on opposite sides.

Yet another attachment mechanism for securing adjacently aligned pads 20, without interlocking therebetween as described above, is by using the enveloping cover 70 as shown in FIG. 6. More specifically, the covers 70 can be used to secure adjacent, axially aligned fastening pads 20 or 30 in elongated alignment using the fingers 77, 78 of the corresponding cover selectively engaged between engagement teeth 27, 28 of the first pad 20 or 37, 38 of the second pad 30. Using this design, it is not necessary to have angled sections 16 (described below and shown in FIG. 2) to complete the frame assembly since the structural integrity and strength of the frame is provided by the lengths and widths of the cover 70. More specifically, with this design the assembled corner pads 20, 30 may be mitered or perpendicularly for miterless corners. Using this embodiment of the invention, different size frames are more easily and quickly constructed by cutting or breaking at previously scored lengths, one of the plurality of aligned pads since the ends are not interlocking.

Regarding attachment of screening to the frame, the screen material 12 can be a rigid material such as metal, or it can be a flexible material such as plastic, but it is not limited to either of these. As best seen in FIG. 3, the fastened assembly includes the attachment pads 20, 30 and screen material 12 having a mesh that is spaced and sized to receive a stem 22 that passes through a corresponding mesh of the screen material.

Now therefore to assemble, the length and width of the desired frame is first determined. Then, the various lengths of pads are aligned in end-to-end relationship and, using the more preferred embodiment, engaged by frictionally interlocking the male insert 51 with the female slot 52 of the interlocking mechanism 50 between adjacent pads. With this embodiment, corners are made using right-angled sections 16 to complete the frame, although other angled sections may be used to make other geometrically shaped frames. Also, if additional structural support is needed for larger frames, a mullion may be added using T-shaped configured attachment section 17 on opposite sides of the frame assembly 10 as shown in FIG. 2. Except for the shape, the angled and T-shape sections, 16 and 17 respectively, have the same two-part pad configuration for engagement with the screen 12 and attachment with aligned abutting ends, as described above for the first and second pads 20, 30.

Once the attachment pads 20 of the frame are engaged by the interlocking structure at its ends or with the cover 70 to form the desired shape of the frame assembly, screen material 12 is set in place. More specifically, to use the fastening assembly with only a single piece or thickness of screen material, a side edge of the screen material 12 is located facing and over to the inner face 21 of the aligned first pads 20, and the stems 22 are inserted through the mesh of the screen 12 by applying pressure to the outer surface 26 of the pad 20 or cover 70, if secured thereto as described above. Next, each stem on the first pad is aligned with an opening 32 or groove 33 on the second pad. Then force is applied in opposite directions to the outer surfaces 26, 36 of the first and second pads 20, 30 sufficiently to insert the stems 22 into the corresponding receptacle 34 of the second pad 30, thereby attaching the first and second pads to the screen 12. The screen 12 and attached pads 20, 30 are aligned such that the pad and fastener openings 14A-14B, 15A-15B, 61A-61B of the pads are aligned. Fasteners 18, 19 are inserted though the two aligned holes to releasably secure the pads 20, 30 together, and/or the attachment fastener 62 for securing the screen assembly to the support structure 60 to hold the frame in place thereto.

It is worth noting that materials other than woven screen, such as a woven, knit or knotted material of open texture having holes, preferable evenly spaced holes such as those of a screen or net, can be secured between the pads by passing the stems through the mesh and into the receptacles.

The fastening device can be used also to connect two pieces of screen material by abutting their adjacent free edges at the location of the pads. Still further, the fastening device can be used to connect a plastic film 13 to the frame, either alone or over the screen material by overlapping the screen material and plastic film 13 at their edges. To attach a plastic film 13 over the screen, for example, the screen material 12 is first located over the inner face 21 of the first pad 20 as previously described, and the stems are inserted through the mesh of that screen material by applying pressure to the outer surface 26 of the first pad 20. Then, the edge of the plastic film 13 is abutted with the edge of the screen 12. Next, each stem 22 on the first pad is aligned with an opening 32 or groove 33 on the second pad 30, and force is applied in opposite directions to the outer surfaces 26, 36 of the first and second pads sufficiently to insert the stems through the plastic film 13 and into the receptacles 34 of the second pad 30, thereby attaching the first and second pads to the screen and plastic.

In any of the described assemblies, once the screen material 12 and/or plastic film 13 is engaged between the attachment pads 20, 30, and the attachment pads 20, 30 are secured together by fasteners 18, 19, the finishing cover 70 is positioned and snap fit the frame assembly. Angled and T-shaped cover units 76, 79 complement the corresponding corners and T-shape sections 17 to provide an aesthetically appealing appearance of the assemble frame.

As previously described, referring again to FIG. 4A, the finishing cover 70 has an outer face 72, sidewalls 74, 75 perpendicular thereto, and opposing engagement fingers 77, 78 extending at the bottom of each sidewall at a substantially right-angle to the sidewalls for locking engagement with cover engagement teeth 27, 28 on opposite sides of the first pad 20 or, as an alternative, with the cover engagement teeth 37, 38 of the second pad 30 of the fastening device. Which teeth are engaged can depend on the thickness of the screen and/or plastic, the desired tautness of the same and/or the finished appearance desired. The properties of the material of the cover 70 provides sufficient bending flexibility to allow the sidewalls 74, 75 of the cover 70 to flex outward over the second attachment pad 30 and resiliently return to its natural configuration once the fingers 77, 78 of each cover sidewall 74, 75 are in the select position with either the engagement teeth 27, 28, 37, 38. As mentioned, this adjustment feature can be used to keep the screen 12 taut by stretching the screen with the cover's inside-sidewall 74 to compensate for any sagging, without disassembly the first and second pads to reposition the screen. The cover has sufficient bending stiffness to remain in its engaged relationship with the fastening strip 11 while keeping the screen taut.

Figure 4B:
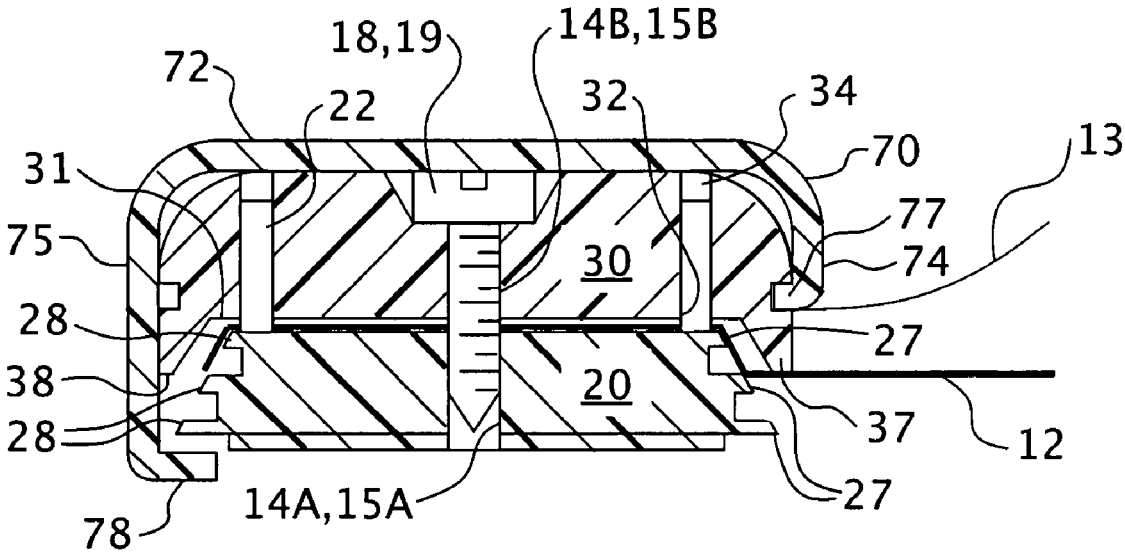
FIG. 4B is an alternative embodiment of the FIG. 4A cover, with this alternative having different cover, sidewall lengths that may be used to accommodate different thicknesses of screen and other securing option for attaching a plastic sheet material.

Finally, it is important to note that the inside-sidewall 74 of the cover can be made shorter than the outside-sidewall 75, as shown in FIG. 4B, so that the cover completely extends over the outside of the combined thickness of the first and second pads 20, 30 with the screen engaged therebetween, while the inside-sidewall 74 is shorter so as to meet flush against the screen or just above it without applying pressure thereagainst. With this configuration, the inside-wall 74 of the cover is in direct contact with the outer surface 36 of the second pad 30. Using this design, plastic can be easily pinched and secured by the engagement finger 77 and the engagement tooth 37, as well as between the inside-wall 74 of the cover 70 and the outer face 36 of the second pad 30, without passing the plastic between attachment pads 20 and 30 as shown in FIG. 4A.

The described versions of the present invention have many advantages, including the ease of assembly of an aesthetically pleasing frame to various sizes and shapes, while maintaining strength and structural integrity. It also provides for more secure positioning of the screen and/or plastic film in openings, such as windows or doors. Although the form of the invention shown and described here constitutes various embodiments of the invention, it is not intended to illustrate all possible forms of the invention. Words used herein are words of description rather than of limitation. Various changes in the form of the invention may be made without departing from the spirit and scope of the invention as disclosed.

What is claimed is:

1. A framing assembly, comprising:

a plurality of elongated first pads, each first pad having spaced stems across a width and length;

a plurality of elongated second pads, each second pad having a width and at least one receptacle being shaped to receive at least one of the stems from the first pad with frictional engagement therebetween, the first and second pads being mated and configured into a multi-sided frame;

a mesh screen being shaped to fit the multi-sided frame and having a weave corresponding in substantial space relation with the spacing of the stems, a portion of the screen being engaged between the first pads and the second pads with the stems passing through the mesh of the weave before passing into the corresponding receptacle of the mated second pad; and a cover having an outer face and spaced outside and inside sidewalls extending substantially perpendicular from the outer face, each sidewall having an engagement finger extending inward at a substantially right angle from said respective sidewall for engagement with locking engagement teeth at respective outside and inside surfaces of either said first or second engaged pads, the cover extending longitudinally over at least a portion of said mated first and second pads, said outer face of the cover spanning the width of the covered second pads, and said inside and outside sidewalls of the cover extending adjacent at least a portion of the outside and inside surfaces, respectively, of said covered second pads.

2. The framing assembly of claim 1, further comprising a plastic film overlay engaged between said cover and a face of either said first or second pads, and said overlay is pinched between at least one of the inside locking engagement teeth and the inside sidewall engagement finger.

3. The framing assembly of claim 1, further comprising a fastener for securing said first and second pads together.

4. The framing assembly of claim 1, wherein the at least one receptacle of each second pad extends into a thickness of the second pad from an elongated groove and the framing assembly further comprises T-shaped first and second pads and a T-shaped cover section to form a supporting mullion.

5. The framing assembly of claim 1, wherein there is one receptacle for each stem, each receptacle extends into a thickness of the second pad from an opening and each receptacle has a cross-sectional area that decreases as the length of the receptacle increases into said thickness.

6. The framing assembly of claim 2, wherein the plurality of first pads are aligned into the multi-sided frame, and each aligned pad is attachable to an adjacent pad at opposing ends, and the inside sidewall engagement finger of the cover engages at least one of the locking engagement teeth on the inside surface of the second pad so that the overlay pinched therebetween is flush to the screen or just above the screen, without applying pressure thereagainst.

7. The framing assembly of claim 6, wherein each aligned pad has a V-shaped male interlocking insert and a matching female interlocking slot at opposing ends for mating engagement to prevent longitudinal separation with adjacent pads.

8. A screen frame comprising:

a plurality of first pads, each having a first pad width and a first face, from which face, spaced stems project in an ordered arrangement;

a plurality of second pads, each having a second pad width and a second face formed with at least one receptacle extending into the second pad, the receptacle being shaped to receive at least one of the stems from the first pad with frictional engagement therebetween;

a screen material having a weave corresponding in substantial space relation with the spacing of the stems, a portion of the screen being engaged between the first pad and the second pad with each stem passing through the mesh of the weave before passing through the corresponding opening and into the receptacle thereof; and a cover for covering at least a portion of mated first and second pads, the cover having an outer face and spaced outside and inside sidewalls extending substantially perpendicular from the outer face, each sidewall having an engagement finger extending inwardly at a substantially right angle from said respective sidewall for engagement with locking engagement teeth at respective outside and inside surfaces of either said first or second covered pads;

wherein the plurality of first pads or plurality of second pads are configured into a multi-sided frame shape and securely attached at opposing ends; and wherein the engagement finger of the outside sidewall is engageable with locking engagement teeth on the outside surface of either said first or second covered pads, and the engagement finger of the inside sidewall is engageable with the locking engagement teeth on the inside surface of the covered second pads, the outer face of the cover extends across the width of the engaged second pads, and said sidewalls of the cover extends alongside at least a portion of both the outside and inside surfaces of said second pads.

9. The screen frame of claim 8, wherein the at least one receptacle of each second pad extends into a thickness of the second pad from an elongated groove and the multi-sided frame shape includes T-shaped first and second pads and a T-shaped cover section to form a mullion for enhanced structural support.

10. The screen frame of claim 8, wherein there is one receptacle for each stem, and each receptacle extends into a thickness of the second pad from an opening, each receptacle has a cross-sectional area that decreases as the length of the receptacle increases into said thickness.

11. The screen frame of claim 9, wherein the plurality of first pads are linearly aligned into the multi-sided frame shape, and each aligned pad being attachable to an adjacent pad at opposing ends.

12. The framing assembly of claim 8, wherein the plurality of first pads are linearly aligned into the multi-sided frame shape, and each aligned pad has a male interlocking insert and a female interlocking slot at opposing ends for mating and interlocking engagement to prevent longitudinal separation with adjacent pads.

13. A method for making a multi-sided screen frame using a plurality of first pads, with each pad having a first width and stems projecting in an ordered, spaced arrangement from an inner surface, and a plurality of second pads, with each having a second width, an inner surface and at least one receptacle arranged to align with the stems, each receptacle being extendable into a thickness of the second pad, the method comprising the steps of:

linearly aligning for attachment the plurality of first pads into a multi-sided frame shape;

attaching each aligned first pad to a linearly adjacent first pad at abutting ends;

inserting the stems of the first pad through the mesh of a screen;

mating at least one of the first pads with one of the second pads by aligning the receptacle of said mating second pad with the stems of the mating first pad, and applying force in opposite directions to the outer surfaces of the first and second pads sufficiently to insert the stems into said receptacle, thereby securing the noted first and second pads to the screen of the assembled multi-sided frame; and covering at least a portion of the mated first and second pads with a cover having an outer face and spaced outside and inside sidewalls extending substantially perpendicular from the outer face, each sidewall having an engagement finger extending laterally inward at an angle from said respective sidewall for engagement with at least one of the locking engagement teeth of an outside wall of either said mated first or second pads and the inside sidewall engagement finger of the cover engages at least one of the inside locking engagement teeth of the mated second pads, the outer face of the cover extends across the width of the second pads engaged by the cover, and said sidewalls of the cover extend alongside and aesthetically cover at least a portion of both the outside and inside walls of said engaged second pads.

14. The method of claim 13, further comprising:

attaching a fastener at a location on the secured first and second pads to a supporting structure; and wherein the assembled multi-sided frame shape includes T-shaped first and second pads and a T-shaped cover portion to form a mullion for enhanced structural support.

15. The method of claim 13, wherein the at least one receptacle of each second pad extends into a thickness of the second pad from an elongated groove and each receptacle has a cross-sectional area that decreases as the length of the receptacle increases into said thickness.

16. The method of claim 13, wherein there is one receptacle for each stem, and each receptacle extends into a thickness of the second pad from an opening, each receptacle has a cross-sectional area that decreases as the length of the receptacle increases into said thickness.

17. The method of claim 13, wherein each linearly aligned pad is attachable to the adjacent pad by a male interlocking insert and a female interlocking slot.

* * * * *